US008152158B2

(12) United States Patent
Hsu

(10) Patent No.: US 8,152,158 B2
(45) Date of Patent: Apr. 10, 2012

(54) AUTOMATIC DOCUMENT FEEDER WITH SHEET PICK-UP MODULE

(75) Inventor: Wei-Hsun Hsu, Taipei (TW)

(73) Assignee: Primax Electronics Ltd., Taipei (TW)

( * ) Notice: Subject to any disclaimer, the term of this patent is extended or adjusted under 35 U.S.C. 154(b) by 250 days.

(21) Appl. No.: 12/685,300

(22) Filed: Jan. 11, 2010

(65) Prior Publication Data

US 2011/0115151 A1 May 19, 2011

(30) Foreign Application Priority Data

Nov. 13, 2009 (TW) ..... 98138655 A

(51) Int. Cl.
*B65H 3/06* (2006.01)

(52) U.S. Cl. ..... 271/118; 271/117; 271/901

(58) Field of Classification Search ..... 271/117, 271/118

See application file for complete search history.

(56) References Cited

U.S. PATENT DOCUMENTS 3,934,754 A * 1/1976 Dutro ..... 221/213
7,571,905 B2 * 8/2009 Kim ..... 271/117
7,594,651 B2 * 9/2009 Hall et al. ..... 271/117
8,002,267 B2 * 8/2011 Iemura et al. ..... 271/117
2005/0184449 A1 * 8/2005 Morimoto et al. ..... 271/118
2008/0277861 A1 * 11/2008 Bato-on et al. ..... 271/18

FOREIGN PATENT DOCUMENTS

JP 02204233 A * 8/1990
JP 03172239 A * 7/1991

* cited by examiner

*Primary Examiner* — Jeremy R Severson
(74) *Attorney, Agent, or Firm* — Kirton & McConkie; Evan R. Witt

(57) ABSTRACT

An automatic document feeder includes a top cover having a fixing structure and first attracting element, a sheet pick-up module and a second attracting element. The fixing structure and the first attracting element are disposed on an inner surface of the top cover. The sheet pick-up module includes a sheet pick-up arm. The sheet pick-up arm is rotated to either a standby position or a sheet feeding position. The second attracting element is disposed on the sheet pick-up arm. When the sheet pick-up arm is rotated to the sheet feeding position, the sheet pick-up module feeds the sheet into an internal portion of the automatic document feeder. When the sheet pick-up arm is rotated to the standby position, the first attracting element and the second attracting element are attracted by each other so that the sheet pick-up arm is fixed on the standby position.

12 Claims, 7 Drawing Sheets

AUTOMATIC DOCUMENT FEEDER WITH SHEET PICK-UP MODULE

FIELD OF THE INVENTION

The present invention relates to an automatic document feeder, and more particularly to an automatic document feeder having a mechanism for facilitating fixing a sheet pick-up arm in a standby position.

BACKGROUND OF THE INVENTION

An office machines such as a multifunction peripheral and an image scanning apparatus becomes an essential electronic device in the office. For continuously feeding a stack of documents to increase the scanning speed, the multifunction peripheral and the image scanning apparatus usually has an automatic document feeder.

FIG. 1 is a schematic view illustrating an automatic document feeder disclosed in U.S. Pat. No. 6,792,241. As shown in FIG. 1, the automatic document feeder 1 comprises a sheet pick-up arm 10, a sheet pick-up roller 11, a separation pad 12, a separation roller 13 and a stopper 14. The stopper 14 is disposed in the sheet feeding path C. The stopper 14 has a stopping surface 14*a*.

The sheet pick-up arm 10 of the automatic document feeder 1 is used for feeding the sheets D into the inner portion of the automatic document feeder 1. The sheet pick-up arm 10 may be switched between a standby position and a sheet feeding position. As shown in FIG. 1, the sheet pick-up arm 10 is in the standby position. When the sheet pick-up arm 10 is lifted to the standby position, the stopping surface 14*a* of the stopper 14 is vertically inserted into the sheet feeding path C to stop the sheets D from entering the inner portion of the automatic document feeder 1.

FIG. 2 is a schematic view illustrating the automatic document feeder of FIG. 1, in which the sheet pick-up arm is in a sheet feeding position. When the scanning operation is activated, the sheet pick-up arm 10 is lowered to the sheet feeding position. At the same time, the stopper 14 is pressed down by the sheet pick-up arm 10, and the stopping surface 14*a* is distant from the sheet feeding path C. Under this circumstance, the sheets D are no longer stopped by the stopping surface 14*a*, and thus the sheets D will be successively fed into the internal portion of the automatic document feeder 1 by the sheet pick-up roller 11.

The conventional automatic document feeder 1, however, still has some drawbacks. For example, since the sheet pick-up arm 10 should be maintained in the standby position when no sheet feeding operation is performed, proper magnitude of electricity is required to have the sheet pick-up arm 10 stay in the standby position. For achieving a power-saving purpose, the office machine having an automatic document feeder 1 (e.g. a multifunction peripheral or an automatic sheetfed scanner) is operated in a sleeping mode or a power-saving mode if the office machine is not used. In a case that the automatic document feeder 1 is in the sleeping mode or the power-saving mode, the electricity magnitude is not sufficient to have the sheet pick-up arm 10 stay in the standby position. Due to insufficient electricity magnitude, the sheet pick-up arm 10 fails to continuously stay in the standby position when the automatic document feeder 1 is in the sleeping mode or the power-saving mode. Meanwhile, due to the gravity of the sheet pick-up arm 10, the stopper 14 is pressed down by the sheet pick-up arm 10, and the stopping surface 14*a* is distant from the sheet feeding path C. Under this circumstance, the sheet stopping function of the stopper 14 is lost. If the user forgets that the automatic document feeder 1 is in the sleeping mode but forces a stack of sheets to be introduced into the automatic document feeder 1, many sheets may be erroneously inserted into the sheet feeding path C. After the automatic document feeder 1 is powered on and the automatic document feeder 1 is in a working mode, the stopper 14 fails to normally stop the sheets D because too many sheets are erroneously inserted into the sheet feeding path C. When the sheet feeding operation is performed, a so-called double feeding problem occurs because too many sheets are jammed in the sheet feeding path C. As such, the automatic document feeder 1 fails to be normally operated.

SUMMARY OF THE INVENTION

It is an object of the present invention to provide an automatic document feeder having a mechanism for facilitating fixing a sheet pick-up arm in a standby position when the automatic document feeder is in a sleeping mode or a power-saving mode, thereby overcoming the double feeding problem encountered in the prior.

In accordance with an aspect of the present invention, there is provided an automatic document feeder for feeding a sheet. The automatic document feeder includes a top cover having a fixing structure and a first attracting element, a sheet pick-up module and a second attracting element. The fixing structure and the first attracting element are disposed on an inner surface of the top cover. The first attracting element is installed on the fixing structure such that a floating gap is formed between the first attracting element and the fixing structure. The sheet pick-up module is arranged under the inner surface of the top cover, and includes a driving shaft and a sheet pick-up arm. The driving shaft is installed on a main body of the automatic document feeder. The sheet pick-up arm is pivotally coupled to the driving shaft. The sheet pick-up arm is rotatable to either a standby position or a sheet feeding position. When the sheet pick-up arm is rotated to the sheet feeding position, the sheet pick-up module feeds the sheet into an internal portion of the automatic document feeder. The second attracting element is disposed on the sheet pick-up arm. The first attracting element and the second attracting element are attracted by each other when the sheet pick-up arm is rotated to the standby position, so that the sheet pick-up arm is fixed on the standby position.

In an embodiment, the fixing structure is an elongate fixing slice, and the first attracting element is sheathed around the elongate fixing slice.

In an embodiment, the automatic document feeder further includes two position-retaining rings attached on the elongate fixing slice. The first attracting element is arranged between the two position-retaining rings.

In an embodiment, one of the first attracting element and the second attracting element is a magnet, and the other of the first attracting element and the second attracting element is a magnet or a metallic piece.

In an embodiment, the sheet pick-up arm includes a pick-up arm casing, a sheet pick-up roller and a separation roller.

In an embodiment, the second attracting element is disposed on the pick-up arm casing.

In an embodiment, the automatic document feeder further includes an insulating piece, which is arranged on a surface of the first attracting element for reducing a magnetically attractive force between the first attracting element and the second attracting element.

In an embodiment, the automatic document feeder further includes a sponge, which is arranged on a surface of the first attracting element for alleviating impact and collision noise generated between the first attracting element and the second attracting element.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides an automatic document feeder. The automatic document feeder is applied to a multi-function peripheral or an automatic sheetfed scanner.

Figure 1:
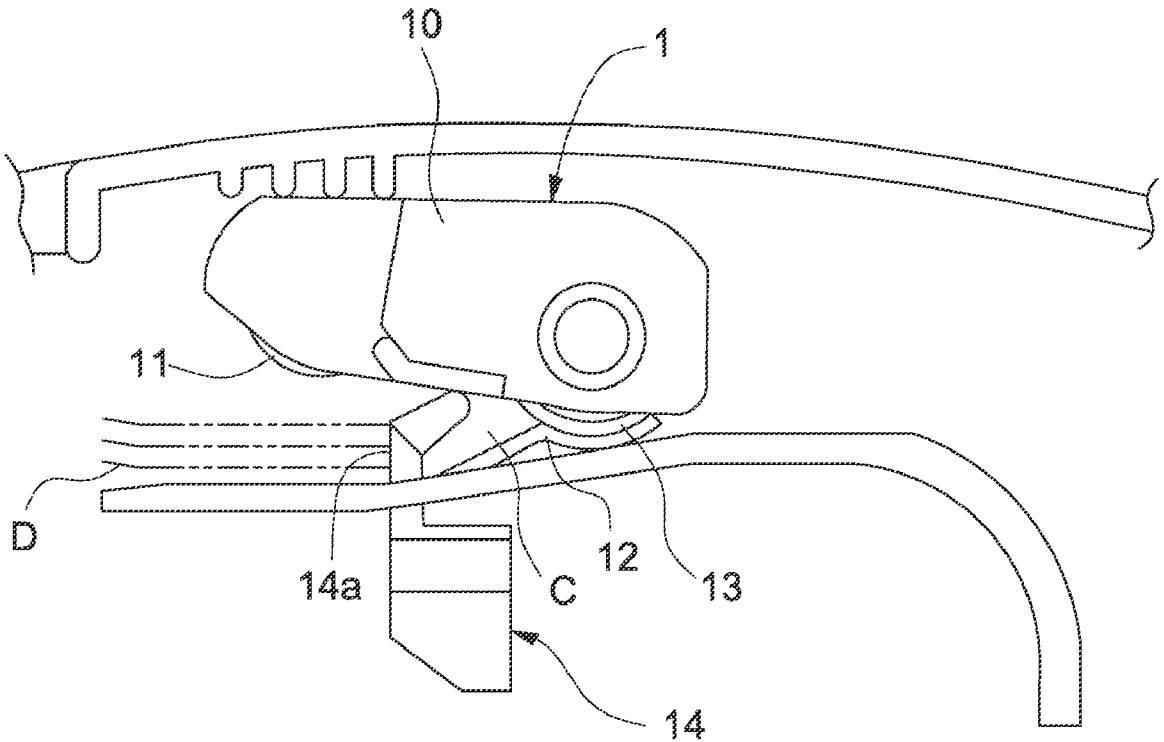
FIG. 1(PRIOR ART)
FIG. 1 is a schematic view illustrating an automatic document feeder according to the prior art, in which the sheet pick-up arm of the automatic document feeder is in a standby position.
Figure 2:
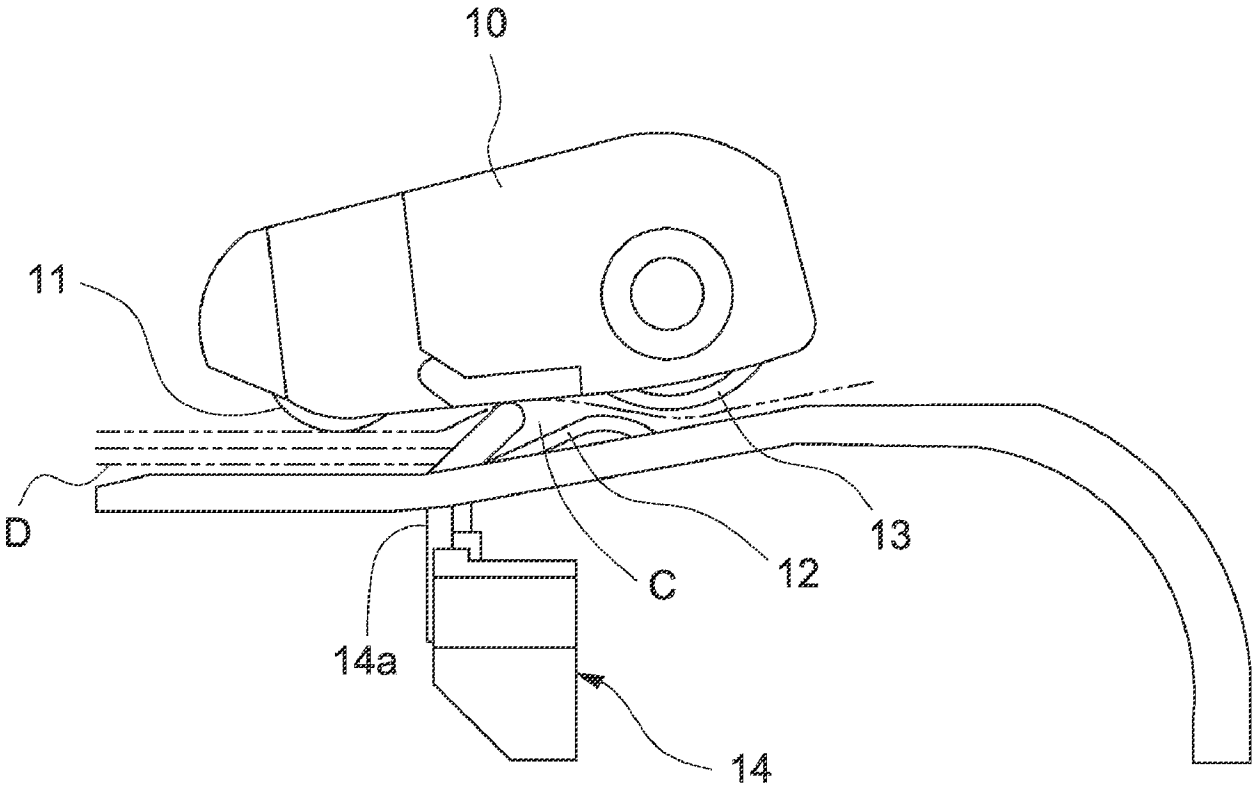
FIG. 2(PRIOR ART)
FIG. 2 is a schematic view illustrating the automatic document feeder of FIG. 1, in which the sheet pick-up arm is in a sheet feeding position.
Figure 3:
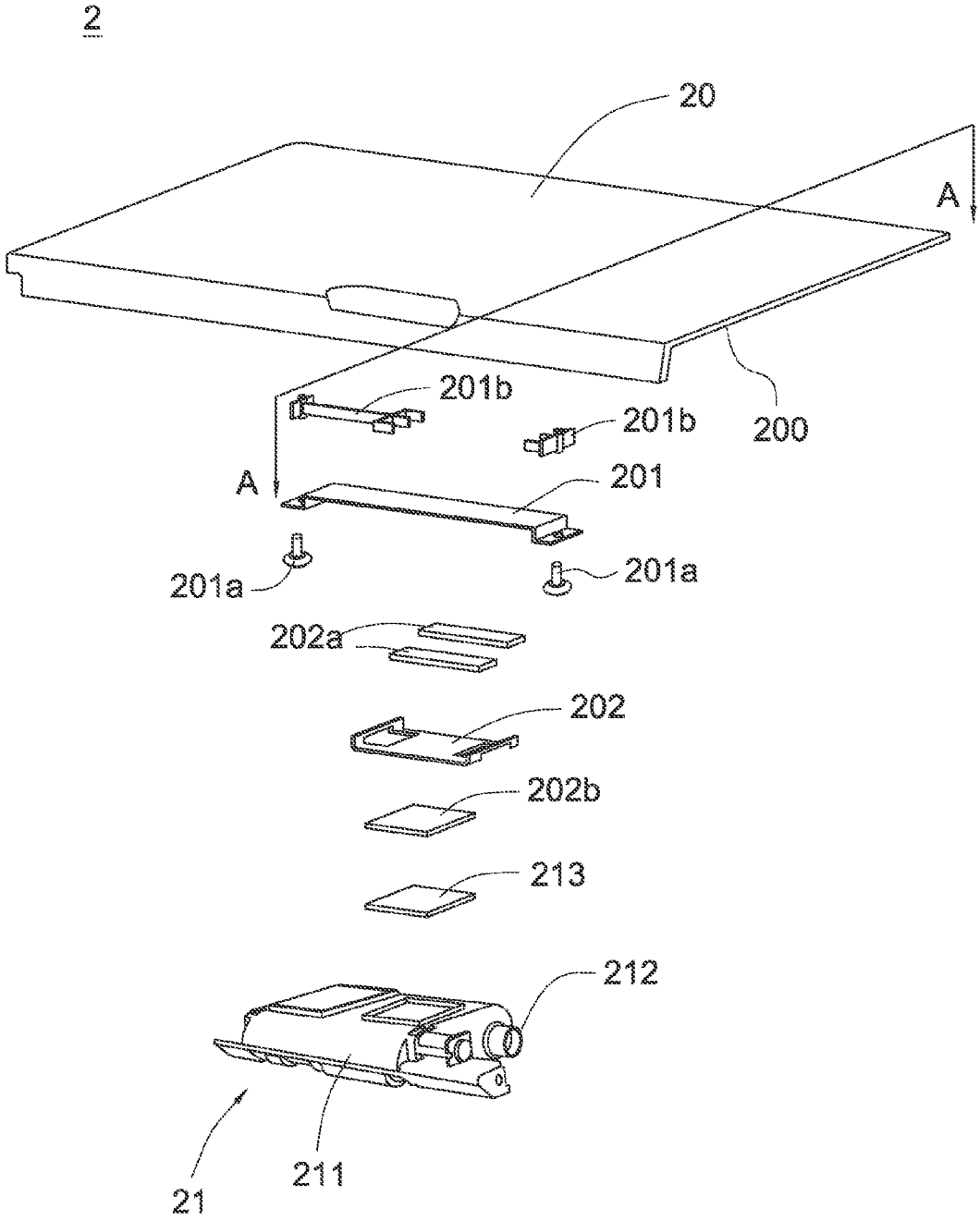
FIG. 3 is a schematic exploded view illustrating an automatic document feeder according to an embodiment of the present invention.

FIG. 3 is a schematic exploded view illustrating an automatic document feeder according to an embodiment of the present invention. As shown in FIG. 3, the automatic document feeder 2 comprises a top cover 20 and a sheet pick-up module 21. The top cover 20 comprises a fixing structure 201 and a first attracting element 202. The sheet pick-up module 21 is used for feeding sheets into the internal portion of the automatic document feeder 2. The sheet pick-up module 21 comprises a sheet pick-up arm 211, a driving shaft 212 and a second attracting element 213.

Figure 4A:
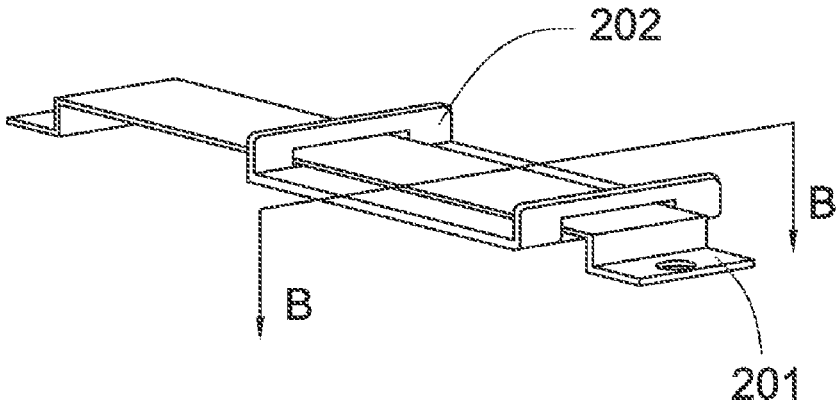
FIG. 4A is a schematic perspective view illustrating a combination of the first attracting element and the fixing structure of the automatic document feeder.
Figure 4B:
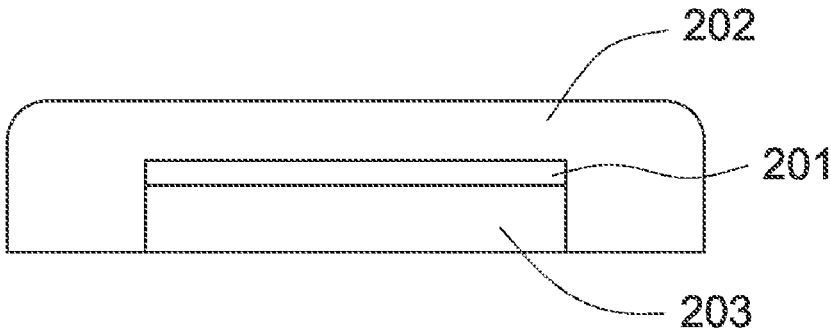
FIG. 4B is a schematic cross-sectional view illustrating the combination of the first attracting element and the fixing structure as shown in FIG. 4A and taken along the line B-B.

Please refer to FIG. 3 again. The first attracting element 202 is installed on the fixing structure 201 (see FIG. 4A) such that a floating gap 203 is formed between the first attracting element 202 and the fixing structure 201 (see FIG. 4B). In this embodiment, the first attracting element 202 is sheathed around the fixing structure 201. By means of screws 201*a*, the fixing structure 201 is fastened on an inner surface 200 of the top cover 20. In addition, two position-retaining rings 201*b* are arranged between the fixing structure 201 and the top cover 20, and respectively attached on both ends of the fixing structure 201. The first attracting element 202 is arranged between these two position-retaining rings 201*b*. The sheet pick-up arm 211 comprises a pick-up arm casing 211*a*, a sheet pick-up roller 211*b* and a separation roller 211*c* (see FIG. 6). The driving shaft 212 is penetrated through the sheet pick-up arm 211 and sheathed by the separation roller 211*c*. The second attracting element 213 is disposed on the outer surface of the pick-up arm casing 211*a*. In the embodiment of FIG. 3, the automatic document feeder 2 further comprises a sponge 202*a* and an insulating piece 202*b*. The sponge 202*a* and the insulating piece 202*b* are attached on an inner surface and an outer surface of the first attracting element 202, respectively. In this embodiment, the fixing structure 201 is an elongate fixing slice. In addition, one of the first attracting element 202 and the second attracting element 213 is a magnet, and the other of the first attracting element 202 and the second attracting element 213 is a magnet or a metallic piece.

Figure 5:
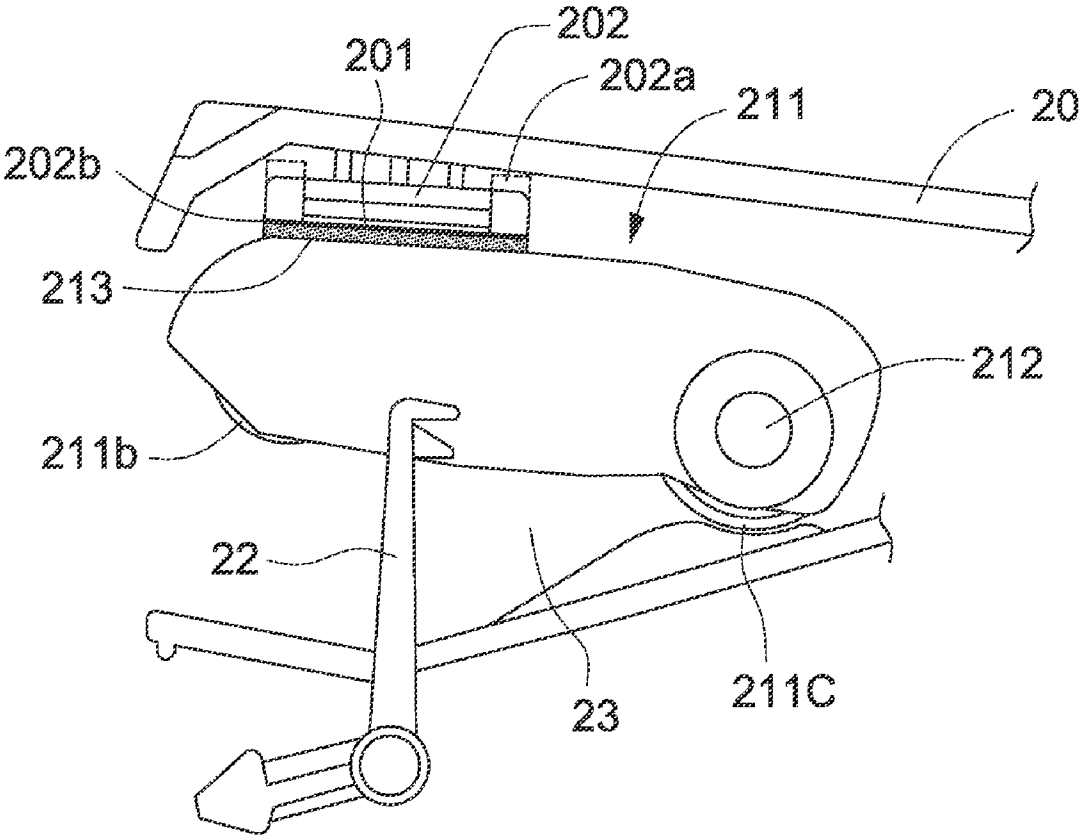
FIG. 5 is a schematic cross-sectional view illustrating the automatic document feeder of FIG. 3 and taken along the line A-A, in which the sheet pick-up arm of the automatic document feeder is in a standby position.
Figure 6:
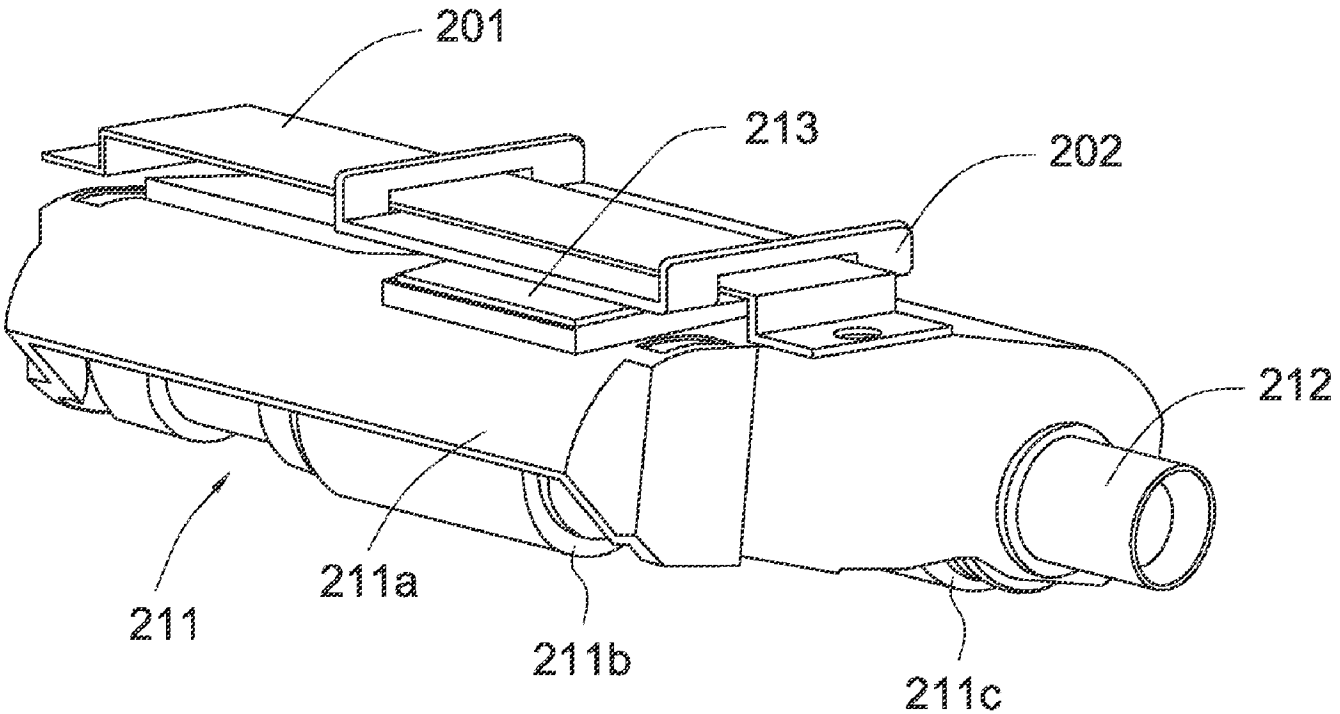
FIG. 6 is an enlarged fragmentary view illustrating a combination of the first attracting element and the second attracting element of the sheet pick-up arm in the standby position.

FIG. 5 is a schematic cross-sectional view illustrating the automatic document feeder of FIG. 3, in which the sheet pick-up arm of the automatic document feeder is in a standby position. FIG. 6 is an enlarged fragmentary view illustrating a combination of the first attracting element and the second attracting element of the sheet pick-up arm in the standby position. As known, depending on different sheet-feeding statuses, the sheet pick-up arm 211 may be rotated to either the standby position or the sheet feeding position. In a case that no sheet feeding operation is done, the electric current provided by the automatic document feeder 2 is transmitted to the driving shaft 212, so that the sheet pick-up arm 211 is driven by the driving shaft 212 to be rotated to the standby position. Meanwhile, the second attracting element 213 and the first attracting element 202 are attracted by each other, so that the second attracting element 213 is attached on the first attracting element 202 (see FIG. 6). In addition, the stopper 22 is maintained upright to stop the sheets from entering the internal portion of the automatic document feeder 2 through a sheet feeding path 23 (see FIG. 5).

After the second attracting element 213 is attached on the first attracting element 202, the first attracting element 202 is movable upwardly within the range of the floating gap 203 in a cushioning manner. Due to the floating gap 203, a strong impact generated during the first attracting element 202 and the second attracting element 213 are attracted by each other will be alleviated. Under this circumstance, the possibility of causing deformation of the top cover 20 will be minimized. Moreover, since the sponge 202*a* is attached on the inner surface of the first attracting element 202, the impact and collision noise generated between the first attracting element 202 and the second attracting element 213 may be alleviated by the sponge 202*a*. The use of the insulating piece 202*b* may reduce the magnetically attractive force between the first attracting element 202 and the second attracting element 213.

Figure 7:
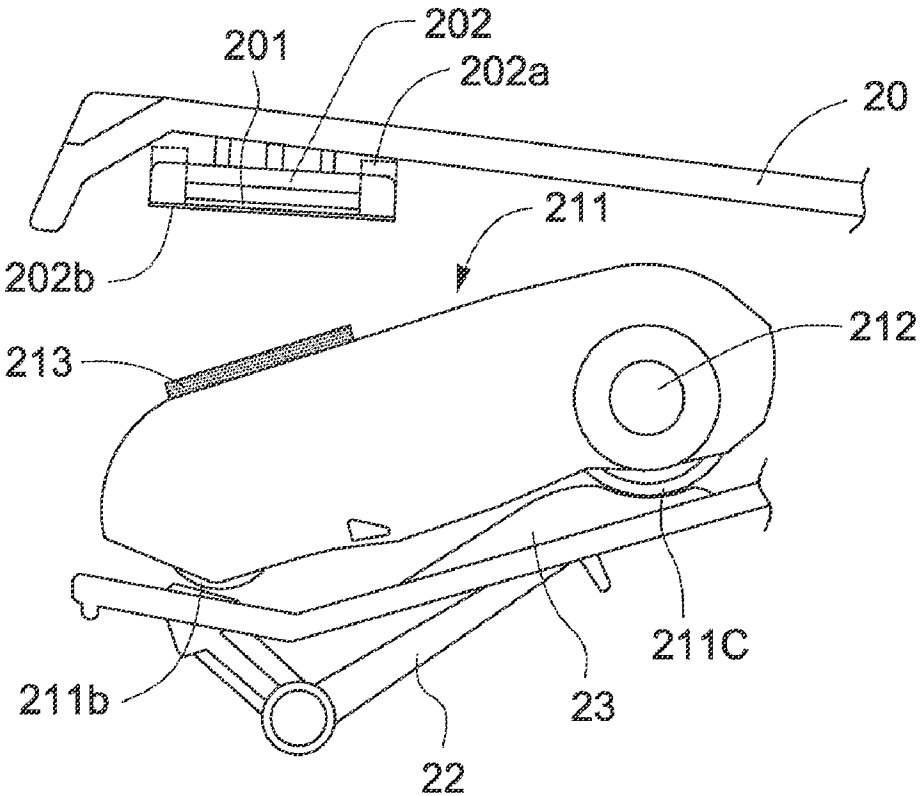
FIG. 7 is a schematic cross-sectional view illustrating the automatic document feeder of FIG. 3 and taken along the line A-A, in which the sheet pick-up arm of the automatic document feeder is in a sheet feeding position.

FIG. 7 is a schematic cross-sectional view illustrating the automatic document feeder of FIG. 3 and taken along the line A-A, in which the sheet pick-up arm of the automatic document feeder is in a sheet feeding position. For performing the sheet feeding operation by the automatic document feeder 2, the sheet pick-up arm 211 is driven by the driving shaft 212 to rotate. Upon rotation of the sheet pick-up arm 211, the sheet pick-up arm 211 is lowered to the sheet feeding position. Since the intensity of the electric current provided by the automatic document feeder 2 is sufficient to withstand the magnetically attractive force between the first attracting element 202 and the second attracting element 213, the electric current could trigger to the driving shaft 212 such that the sheet pick-up arm 211 is lowered to the sheet feeding position. Meanwhile, the sheets are no longer stopped by the stopper 22, so that the sheets could be successively fed into the internal portion of the automatic document feeder 2 by the sheet pick-up roller 211*b*.

On the other hand, in a case that no sheet feeding operation is done, the sheet pick-up arm 211 is in the standby position. If the electric current is insufficient to trigger the driving shaft 212 to maintain the sheet pick-up arm 211 in the standby position, the sheet pick-up arm 211 may still stay in the standby position due to the magnetically attractive force between the first attracting element 202 and the second attracting element 213. In other words, the gravity of the sheet pick-up arm fails to naturally lower the sheet pick-up arm to the sheet feeding position.

From the above description, since the first attracting element 202 and the second attracting element 213 are magnetically attracted by each other when the automatic document feeder 2 of a multifunction peripheral or an automatic sheet-fed scanner is in a power-saving mode or a sleeping mode, the sheet pick-up arm 211 could still stay in the standby position even if the electricity magnitude is insufficient. Under this circumstance, gravity of the sheet pick-up arm 211 fails to naturally lower the sheet pick-up arm 211 to the sheet feeding position. As a consequence, the stopper 22 is maintained upright to stop the sheets from entering the internal portion of the automatic document feeder 2 through a sheet feeding path 23. Even if the user forgets that the automatic document feeder 2 is in the power-saving mode or the sleeping mode but forces a stack of sheets to be introduced into the automatic document feeder 2, the sheet pick-up arm 211 still stays in the standby position and thus the problem of erroneously inserting many sheets into the sheet feeding path 23 is eliminated. After the automatic document feeder 2 is powered on and the automatic document feeder 2 is in a working mode, the double feeding problem or getting jam of the sheet feeding path 23 will be minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for feeding a sheet, said automatic document feeder comprising:

a top cover having a fixing structure and a first attracting element disposed on an inner surface thereof, wherein said first attracting element is installed on said fixing structure such that a floating gap is formed between said first attracting element and said fixing structure, wherein said fixing structure is an elongate fixing slice, and said first attracting element is sheathed around the elongate fixing slice;

two position-retaining rings attached on said elongate fixing slice, wherein said first attracting element is arranged between said two position-retaining rings;

a sheet pick-up module arranged under said inner surface of said top cover, and comprising a driving shaft and a sheet pick-up arm, wherein said driving shaft is installed on a main body of said automatic document feeder, said sheet pick-up arm is pivotally coupled to said driving shaft, and said sheet pick-up arm is rotatable to either a standby position or a sheet feeding position, wherein said sheet pick-up module feeds said sheet into an internal portion of the automatic document feeder when said sheet pick-up arm is rotated to said sheet feeding position; and a second attracting element disposed on said sheet pick-up arm, wherein said first attracting element and said second attracting element are attracted by each other when said sheet pick-up arm is rotated to said standby position, so that said sheet pick-up arm is fixed on said standby position.

2. The automatic document feeder according to claim 1 wherein said sheet pick-up arm comprises a pick-up arm casing, a sheet pick-up roller and a separation roller.

3. The automatic document feeder according to claim 2 wherein said second attracting element is disposed on said pick-up arm casing.

4. The automatic document feeder according to claim 1 further comprising a sponge, which is arranged on a surface of said first attracting element for alleviating impact and collision noise generated between said first attracting element and said second attracting element.

5. An automatic document feeder for feeding a sheet, said automatic document feeder comprising:

a top cover having a fixing structure and a first attracting element disposed on an inner surface thereof, wherein said first attracting element is installed on said fixing structure such that a floating gap is formed between said first attracting element and said fixing structure;

a sheet pick-up module arranged under said inner surface of said top cover, and comprising a driving shaft and a sheet pick-up arm, wherein said driving shaft is installed on a main body of said automatic document feeder, said sheet pick-up arm is pivotally coupled to said driving shaft, and said sheet pick-up arm is rotatable to either a standby position or a sheet feeding position, wherein said sheet pick-up module feeds said sheet into an internal portion of the automatic document feeder when said sheet pick-up arm is rotated to said sheet feeding position; and a second attracting element disposed on said sheet pick-up arm, wherein said first attracting element and said second attracting element are attracted by each other when said sheet pick-up arm is rotated to said standby position, so that said sheet pick-up arm is fixed on said standby position, wherein one of said first attracting element and said second attracting element is a magnet, and the other of said first attracting element and said second attracting element is a magnet or a metallic piece.

6. The automatic document feeder according to claim 5 wherein said sheet pick-up arm comprises a pick-up arm casing, a sheet pick-up roller and a separation roller.

7. The automatic document feeder according to claim 6 wherein said second attracting element is disposed on said pick-up arm casing.

8. The automatic document feeder according to claim 5 further comprising a sponge, which is arranged on a surface of said first attracting element for alleviating impact and collision noise generated between said first attracting element and said second attracting element.

9. An automatic document feeder for feeding a sheet, said automatic document feeder comprising:

a top cover having a fixing structure and a first attracting element disposed on an inner surface thereof, wherein said first attracting element is installed on said fixing structure such that a floating gap is formed between said first attracting element and said fixing structure;

a sheet pick-up module arranged under said inner surface of said top cover, and comprising a driving shaft and a sheet pick-up arm, wherein said driving shaft is installed on a main body of said automatic document feeder, said sheet pick-up arm is pivotally coupled to said driving shaft, and said sheet pick-up arm is rotatable to either a standby position or a sheet feeding position, wherein said sheet pick-up module feeds said sheet into an internal portion of the automatic document feeder when said sheet pick-up arm is rotated to said sheet feeding position; and a second attracting element disposed on said sheet pick-up arm, wherein said first attracting element and said second attracting element are attracted by each other when said sheet pick-up arm is rotated to said standby position, so that said sheet pick-up arm is fixed on said standby position, further comprising an insulating piece, which is arranged on a surface of said first attracting element for reducing a magnetically attractive force between said first attracting element and said second attracting element.

10. The automatic document feeder according to claim 9 wherein said sheet pick-up arm comprises a pick-up arm casing, a sheet pick-up roller and a separation roller.

11. The automatic document feeder according to claim 10 wherein said second attracting element is disposed on said pick-up arm casing.

12. The automatic document feeder according to claim 9 further comprising a sponge, which is arranged on a surface of said first attracting element for alleviating impact and collision noise generated between said first attracting element and said second attracting element.

* * * * *